United States Patent [19]

Bourassa

[11] Patent Number: 4,956,582

[45] Date of Patent: Sep. 11, 1990

[54] LOW TEMPERATURE PLASMA GENERATOR WITH MINIMAL RF EMISSIONS

[75] Inventor: Roger J. Bourassa, Kent, Wash.

[73] Assignee: The Boeing Company, Seattle, Wash.

[21] Appl. No.: 183,648

[22] Filed: Apr. 19, 1988

[51] Int. Cl.[5] ..... H01J 7/24; H01J 17/26; H05B 31/26; H01Q 3/10

[52] U.S. Cl. ..... 315/111.21; 315/111.51; 313/231.41; 333/25; 343/859

[58] Field of Search ..... 315/111.21, 111.51; 313/231.31, 231.41; 250/426; 343/859, 861; 333/25, 32

[56] References Cited

U.S. PATENT DOCUMENTS

| | | | |
|---|---|---|---|
| 1,998,322 | 4/1935 | Kaar | 333/25 |
| 2,196,673 | 4/1940 | Gutzmann | 333/25 |
| 3,569,777 | 3/1969 | Beaudry | 315/111.21 |
| 3,678,334 | 7/1972 | Dugdale et al. | 315/111 |
| 4,201,579 | 5/1980 | Robinson et al. | 430/323 |
| 4,306,175 | 12/1981 | Schleicher et al. | 315/111.21 |
| 4,341,947 | 7/1982 | Komura et al. | 219/383 |
| 4,629,940 | 12/1986 | Gagne et al. | 315/111.51 |
| 4,686,022 | 8/1987 | Rempt | 204/157.41 |
| 4,717,896 | 1/1988 | Graham | 333/25 |
| 4,800,344 | 1/1989 | Graham | 333/25 |
| 4,810,933 | 3/1989 | Moisan et al. | 315/111.21 |

FOREIGN PATENT DOCUMENTS 0293011 12/1986 Japan ..... 333/25

*Primary Examiner*—Eugene R. LaRoche
*Assistant Examiner*—Michael B. Shingleton
*Attorney, Agent, or Firm*—Christensen, O'Connor, Johnson & Kindness

[57] ABSTRACT

A low temperature plasma generator having reduced radio frequency (RF) emissions, and a method for reducing the RF emissions of a plasma generator. A low temperature plasma generator (100) includes a pair of electrodes (150 and 160) that are energized by an RF power supply (138) through a balanced impedance matching network (200). The impedance matching network includes a balun transformer (158), matched variable inductors (222 and 230), a fixed capacitor (240) in parallel with a variable capacitor (244) and a fixed capacitor (242) in parallel with a variable capacitor (246). The RF potential on electrodes (150 and 160) varies sinusoidally between opposite positive and negative values with respect to ground potential, such that the net potential on the two electrodes with respect to ground is always substantially equaol to zero, thus eliminating a glow discharge current and radiation emissions that otherwise are produced by similar prior art low temperature plasma generators.

19 Claims, 2 Drawing Sheets

LOW TEMPERATURE PLASMA GENERATOR WITH MINIMAL RF EMISSIONS

TECHNICAL FIELD

This invention generally pertains to a device for generating a plasma, and specifically to a plasma generator using radio frequency (RF) energy to dissociate diatomic molecules, such as $O_2$.

BACKGROUND OF INVENTION

Low orbit satellites are frequently exposed to monatomic oxygen present in the upper limits of the earth's atmosphere. It has been found that certain materials used in satellites are extremely reactive with monatomic oxygen, even in the relatively limited extent to which it is present in the rarefied upper atmosphere. These materials are significantly degraded or destroyed through the process of chemical oxidation resulting from exposure to this substance. Since there is little correlation to the reaction of the material with diatomic oxygen molecules, $O_2$, the state in which oxygen is normally found on the surface of the earth, it is difficult to predict the reaction potential of a material with monatomic oxygen. Therefore, empirical testing provides the only reliable basis for determining whether a material is sufficiently resistant to reaction with monatomic oxygen for use in satellites. To carry out such tests, a source of monatomic oxygen is required.

Although normally used to produce positively charged ions by removing one or more valence electrons from an atom, a plasma generator may also be used to dissociate diatomic oxygen molecules into monatomic oxygen. Certain types of plasma generators use a DC field or an RF induction coil to generate ionized particles, but are not suitable for producing monatomic oxygen for testing material specimens, because the heat generated by either of these methods does not properly simulate the desired low temperature conditions of outer space. However, another type of plasma generator produces a relatively low temperature plasma by ionizing atoms as they pass between two spaced-apart electrodes that are excited with an RF signal. Even using this method, it is preferable to produce the monatomic oxygen in a separate section of the plasma generator, so that it cools slightly before entering a test section in which the material under test is disposed.

In the conventional approach to generating a low temperature plasma with this method, one of the electrodes is grounded and an RF signal referenced to ground potential is applied to the other electrode. In attempting to use apparatus thus constructed, it was found that substantial RF energy was radiated by the plasma generator, requiring that it be fully shielded to prevent radiation levels in its vicinity from exceeding safe limits. Even with this shielding, radiation emanating from the unit interfered with thermocouples and other nearby laboratory equipment used in monitoring the test section. In addition, specimens and a specimen holder disposed in the test section of the device were subjected to heating caused by a plasma glow discharge current flowing from the energized (nongrounded) electrode to a grounded screen disposed in the test section. The grounded screen was installed to protect a vacuum pump attached to the device from the glow discharge current. These problems made it difficult, if not impossible, to use the low temperature plasma generator for its intended purpose.

Accordingly, it is an object of the present invention to substantially reduce the RF radiation from a low temperature plasma generator, and to eliminate heating of a specimen due to a glow discharge current. These and other objects and advantages of the present invention will be apparent from the attached drawings and from the Description of the Preferred Embodiment that follows.

SUMMARY OF THE INVENTION

In accordance with the present invention, a low temperature plasma generator includes a chamber formed of a material that is substantially electrically nonconductive. The chamber includes a vacuum port adapted for connection to a vacuum pump and an inlet port adapted for connection to a source of a gas. A first and a second electrode are disposed in proximity to the chamber, spaced apart, but generally adjacent each other.

A radio frequency power source referenced to ground potential is connected to a primary terminal of a transformer, another primary terminal being connected to ground potential. Secondary terminals of the transformer are isolated from ground potential and are of opposite polarity relative to ground. Balanced impedance matching means connect the secondary terminals of the transformer to the first and second electrodes and are operative to match the output impedance of the secondary terminals to the input impedance of the first and second electrodes.

The balanced impedance matching means comprise a balanced LC circuit having a first current path referenced to the first electrode and ground potential and a second current path referenced to the second electrode and ground potential. Each current path includes a variable inductor and a variable capacitor, permitting the impedance of the circuit to be adjusted.

The chamber includes a glow discharge section on which are disposed the inlet port and the first and second electrodes, and a test section on which is disposed the vacuum port. Optionally, the plasma generator may include a ground potential electrode, placed inside the chamber, proximate to the vacuum port and comprising an electrically conductive screen that is connected to ground potential by a conductive lead that passes through the material forming the chamber.

In another aspect of the invention, a method of reducing radio frequency emissions from a low temperature plasma generator includes the step of converting a radio frequency power source signal referenced to ground potential into a pair of opposite polarity signals relative to ground potential using a transformer that is connected to the power source. The output impedance of the transformer is matched to the input impedance of two electrodes of the plasma generator so that the opposite polarity signals are balanced when applied to the electrodes. The matching impedance is trimmed to compensate for dynamic changes in the input impedance of the two electrodes during operation of the plasma generator.

DISCLOSURE OF THE PREFERRED EMBODIMENT

Figure 1:
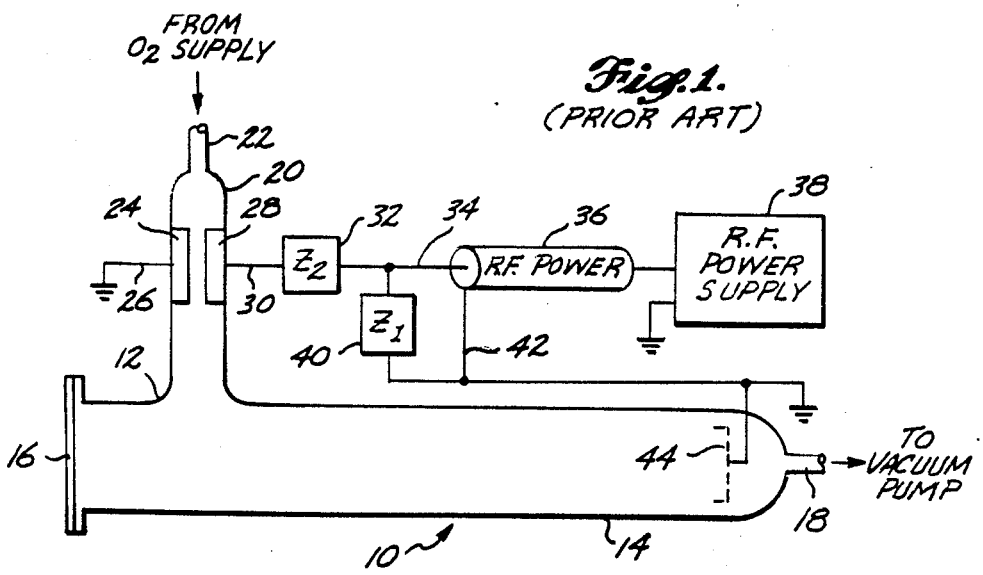
Fig. 1. (PRIOR ART)
FIG. 1 is a schematic illustration of a prior art low temperature plasma generator.

With reference to FIG. 1, a low temperature plasma generator representing a prior art design is generally indicated by reference numeral 10. Prior art plasma generator 10 includes an "L" shaped chamber 12, having a test section 14, in which a specimen to be exposed to monatomic oxygen produced by the plasma generator may be positioned. Access to the interior of test section 14 is provided through a flanged port at one end, which is normally covered by a cover plate 16. The cover plate may be removed for insertion or removal of test specimens and monitoring devices (not shown). The other end of test section 14 includes a vacuum pump port 18, which is connected by a flexible line (not shown) to a vacuum pump (also not shown). The vacuum pump is used to evacuate chamber 12 to a pressure of approximately 70 millitorr (of Hg) prior to operation of the plasma generator.

A glow discharge section 20 extends from one side of test section 14, forming the other leg of the "L" shaped chamber. Glow discharge section 20 includes a gas port 22, which is connected to a metered supply of diatomic oxygen ($O_2$) gas for use in testing the susceptibility of a material specimen to reaction with monatomic oxygen produced by the plasma generator. A curved electrode 24 extends around slightly less than one-half the circumference of the exterior of discharge section 20, and is connected to ground by means of a lead 26. Opposite electrode 24 is another curved electrode 28, also disposed around part of the circumference of the exterior surface of the glow discharge section, but spaced apart from electrode 24. Electrode 28 is connected to an RF power supply 38, through leads 30 and 34, and a coaxial cable 36.

The RF signal output from RF power supply 38 is referenced to ground and is supplied to electrode 28 via an impedance matching circuit, used to match the output impedance of the RF power supply (and the impedance of coaxial cable 36) to the input impedance of electrodes 24 and 28. In this respect, the impedance matching circuit includes a signal-to-electrode impedance, $Z_2$, indicated by reference numeral 32, and a signal-to-ground impedance, $Z_1$, indicated by reference numeral 40. Both impedances $Z_1$ and $Z_2$ may include inductive, capacitive, and resistive components, which are not separately shown in FIG. 1. Coaxial cable 36 is shielded, and the shield is connected to ground via lead 42. Lead 42 also connects to a ground potential electrode 44, disposed inside test section 14, upstream of vacuum pump port 18. The purpose of ground potential electrode 44 is to shield the vacuum pump from any glow discharge current that propagates from glow discharge section 20 into test section 14.

During operation of prior art plasma generator 10, a metered flow of diatomic oxygen gas is provided through inlet port 22. Since a vacuum is continually drawn on test section 14 through vacuum port 18 by the attached vacuum pump, the gaseous oxygen passes between electrodes 24 and 28, where it is subjected to an RF electromagnetic field. The electromagnetic field is sufficiently strong to break the molecular bond of at least some of the diatomic oxygen molecules, producing monatomic oxygen. The resulting mixture of diatomic and monatomic oxygen flows from the glow discharge section and into test section 14.

While thus successful in producing monatomic oxygen, the prior art plasma generator is subject to significant problems associated with radiation generated by the device. This radiation both creates a safety hazard for personnel working in the vicinity of plasma generator 10 and disrupts measurements made using thermocouples disposed within test section 14. In addition, a glow discharge current traveling through the device between electrode 28 and ground potential electrode 44 causes heating of the specimen holder and thus of the material placed within the holder. Such heating cannot be tolerated in experiments intended to simulate exposure of the materials to monatomic oxygen at relatively low temperatures.

Figure 2:
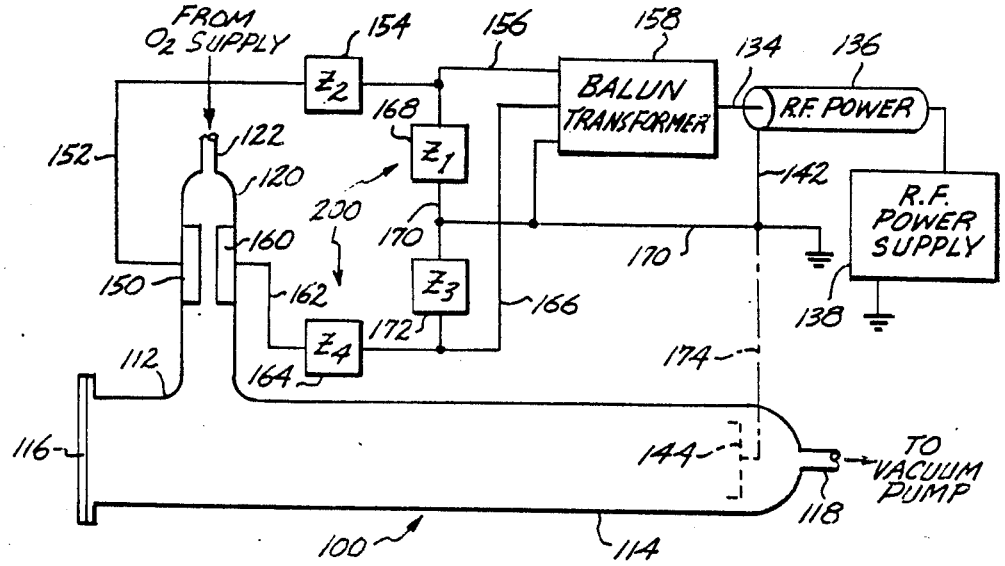
FIG. 2 is a schematic illustration of a low temperature plasma generator, in accord with the present invention.

To remedy these problems, a plasma generator was developed in accord with the present invention, as shown in FIG. 2, generally represented by reference numeral 100. Plasma generator 100 includes many elements common to prior art plasma generator 10, which are identified by reference numerals that differ by "100," from those applied to the prior art plasma generator. For example, plasma generator 100 comprises a chamber 112, which is shaped and functions exactly like chamber 12 of prior art plasma generator 10. Similarly, chamber 112 includes a test section 114 and a glow discharge section 120, equivalent to test section 14 and glow discharge section 20. Test section 114 is connected to a vacuum pump (not shown) by a test port 118, which is disposed at one end, and at its other end includes a flanged access port, which is normally sealed by a cover plate 116.

An electrode 150 comprises a curved metal plate disposed around a portion of the circumference of the exterior of glow discharge section 120, but unlike electrode 24 in the prior art plasma generator, electrode 150 is not grounded. Instead, it is connected (through a balanced impedance matching network 200) to the secondary of a balun transformer 158 by means of conductors 152 and 156. An electrode 160 also comprises a curved metal plate, which is disposed on a portion of the outside circumference of glow discharge portion 120, spaced apart from but opposite electrode 150, and is connected (through the impedance matching network) to the other side of the secondary winding of balun transformer 158 via leads 162 and 166. The primary of balun transformer 158 is connected to an RF power supply 138 through a coaxial cable 136, having a center conductor 134, the RF output signal from the power supply being referenced to ground. A shield in coaxial cable 136 is connected to ground via lead 142.

Use of balun transformer 158 enables electrodes 150 and 160 to be energized with an RF signal that is isolated from ground, so that the RF signal applied to electrodes 150 and 160 is at opposite polarity with respect to ground potential. The relatively low output impedance of balun transformer 158 is matched to the relatively high input impedance of electrodes 150 and 160 by the impedance matching network, comprising a signal-to-electrode impedance, $Z_2$, identified by reference numeral 154, a signal-to-electrode impedance, $Z_4$, identified by reference numeral 164, a signal-to-ground impedance, $Z_1$, identified by reference numeral 168, and a signal-to-ground impedance, $Z_3$, identified by reference numeral 172.

In using plasma generator 100, cover plate 116 is removed and a sample of the material that is to be tested is loaded into a specimen holder (not shown), which is disposed within test section 114. The cover plate is replaced and air is evacuated from chamber 112 using the vacuum pump connected to vacuum port 118. A metered flow of diatomic oxygen gas is provided through input port 122, so that the diatomic molecules of oxygen pass between electrodes 150 and 160. RF power supply 138 is energized and the output impedance of balun transformer 158 is adjusted to match the input impedance of electrodes 150 and 160, as described below. The RF electromagnetic field developed between these two electrodes dissociates at least some of the diatomic molecules of oxygen into monatomic oxygen, and the mixed monatomic and diatomic oxygen flows into the test section. Reactivity of the material specimen with the monatomic oxygen may then be monitored for an extended period of time.

Unlike prior art plasma generator 10, radiation from plasma generator 100 is reduced to such a low level that it is virtually undetectable, even with no shielding used around test section 114. Shielding is still used around glow discharge section 120 and around the balanced impedance matching network comprising impedances $Z_1$ through $Z_4$, but the radiation produced by these components is relatively minimal. Furthermore, test specimens within plasma generator 100 are not subjected to any heating effects due to glow discharge current traveling through the test section. In fact, a screen electrode 144 disposed in front of vacuum port 118 and connected to ground potential via lead 174 is considered optional, since there is almost no RF current flowing through the test section and thus no need to protect the vacuum pump from such current. Thermocouples inserted at the specimen holder, and differential calorimetric probes disposed within the test section operate properly, free of any RF radiation effects.

Figure 3:
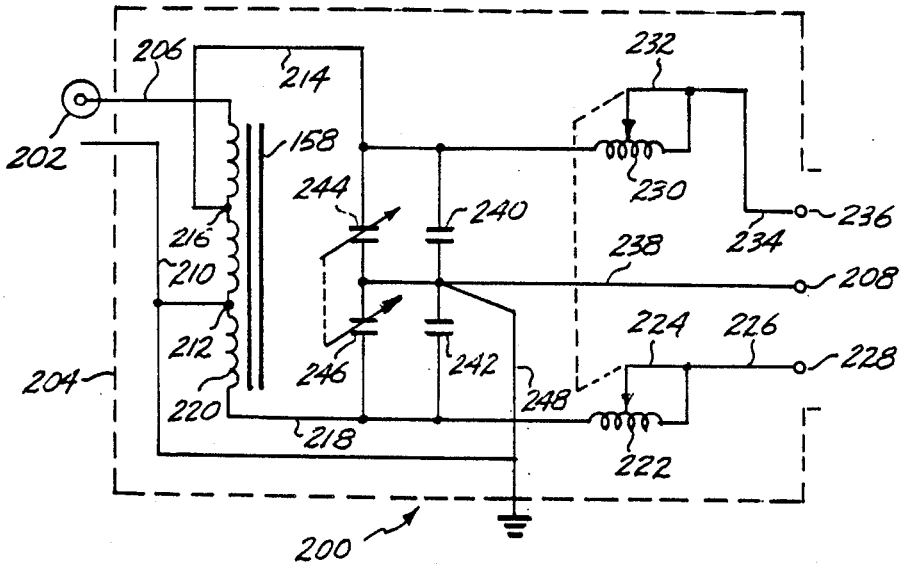
FIG. 3 is an electrical schematic diagram showing the balanced potential impedance matching circuit of the present invention.

Turning now to FIG. 3, details of the balanced impedance matching network 200 used in plasma generator 100 are illustrated. The impedance matching network includes an input connector 202, e.g., a BNC type, or other connector suitable for use with coaxial cable 136. A grounded shield 204 surrounds the impedance matching network 200, protecting against stray RF leakage. From connector 202, the RF signal from RF power supply 138 (shown in FIG. 2) is conveyed by a lead 206 to one end of a primary winding of balun transformer 158. Balun transformer 158 is an autotransformer, having three series connected windings separated by intermediate taps 212 and 216. Other types of transformers having separate primary and secondary windings might also be used. Tap 212 is connected via lead 210 to the outer shield of connector 202 and thus to ground potential. Tap 216 is connected via lead 214 to one end of a variable inductor 230. The other end of the variable inductor is connected to a wiper arm 232 that is used to adjust the inductance, and to a lead 234. Lead 234 conveys an output signal from the variable inductor to an output terminal 236 of the impedance matching network. Similarly, the end of the winding of balun transformer 158 at 220 is connected through a lead 218 to one end of variable inductor 222, its wiper arm 224 being connected to the other end of the variable inductor. An output signal from variable inductor 222 is carried via a lead 226 to an output terminal 228. Variable inductors 222 and 230 are matched, and their wiper arms 224 and 232 are connected together so that the values of their inductance may be adjusted in balance.

A fixed capacitor 240 is connected between lead 214 and a lead 238. Similarly, a fixed capacitor 242 is connected between lead 218 and lead 238. Lead 238 is grounded by a lead 248 and one end of lead 238 is connected to a ground potential terminal 208. A variable capacitor 244 is connected in parallel with fixed capacitor 240, and a variable capacitor 246 is connected in parallel with fixed capacitor 242. Variable capacitors 244 and 246 are matched and ganged, so that adjustment of the capacitance of one produces an equal and balanced change in the capacitance of the other.

With reference to FIG. 2, impedances $Z_1$ through $Z_4$ comprise a balanced LC circuit. While other types of balanced impedance circuits may also be used, in the preferred embodiment, impedance $Z_1$ comprises the sum of the capacitance of fixed capacitor 240 and variable capacitor 244, and impedance $Z_3$ comprises the sum of the capacitance of fixed capacitor 242 and variable capacitor 246. Further, impedance $Z_2$ comprises the inductance of variable inductor 230, and impedance $Z_4$ comprises the inductance of variable inductor 222. Ignoring the inherent resistance, and stray capacitance and inductance of the impedance matching network, impedance $Z_1$ equals impedance $Z_3$ and impedance $Z_2$ equals impedance $Z_4$. The purpose of balanced impedance matching network 200 is to match the low output impedance of balun transformer 158 to the high input impedance of electrodes 150 and 160 (shown in FIG. 2) in a balanced fashion, so that the potentials on the two electrodes are also balanced relative to ground potential.

As will be apparent to those of ordinary skill in the art, a standing wave ratio (SWR) meter (not shown) may be connected between RF power supply 138 and input connector 202 to indicate the extent to which proper impedance matching adjustment has been achieved. Initially, variable capacitors 244 and 246 are adjusted to achieve a minimum indication on the standing wave ratio meter, and variable inductors 224 and 232 are then adjusted until the standing wave ratio meter again indicates a minimum SWR. By repeatedly trimming the variable capacitors and inductors of balanced impedance matching circuit 200, an operator may "tweak" these adjustments to achieve the lowest possible SWR reading, indicating that proper impedance matching has been achieved. During the operation of plasma generator 100, it is likely that it will be necessary to repeat this adjustment from time to time, since the impedance of electrodes 150 and 160 changes dynamically, depending upon conditions inside chamber 112, such as pressure, temperature, and $O_2$ flow rate.

The reduction in radiation emissions from the plasma generator due to use of the balanced impedance matching circuit shown in FIG. 3 results from applying a positive potential to one of electrodes 150 and 160, while the other electrode is energized with an equal but negative potential with respect to ground. As the RF signal applied to the primary connections of balun transformer 158 periodically cycles through its positive and negative sinusoidal waveform, the output signals at secondary taps 216 and 220 likewise respectively cycle through positive and negative potential with respect to ground potential. Accordingly, electrodes 150 and 160 periodically cycle through positive and negative voltages with respect to ground potential, and are always opposite in potential with respect to each other. Since impedances $Z_1$ and $Z_2$ are equal respectively to impedances $Z_3$ and $Z_4$, the net potential applied to electrodes 150 and 160 is always zero with respect to ground potential. Thus, little or no current flows between either electrode and any grounded conductive surface, inside or outside test section 114. For this reason, ground potential electrode 144 is not required to protect the vacuum pump, and is optionally included. The absence of glow discharge current within test section 114 also avoids any heating effects on the material specimens placed within the test section, and eliminates RF interference with instrumentation disposed within the test section.

Plasma generator 100 was specifically developed to produce monatomic oxygen. However, it may be used with any ionizable gases to produce a plasma for other applications. The advantages of the balanced impedance matching network explained above should apply regardless of the application in which plasma generator 100 is used.

While the present invention has been described with respect to a preferred embodiment, those of ordinary skill in the art will recognize that modifications may be made thereto within the scope of the claims that follow below. Accordingly, it is not intended that the scope of the claims be in any way limited by the disclosure, but instead that it be determined entirely by reference to the claims.

The embodiments of the invention in which an exclusive property privilege is claimed are defined as follows:

1. A low temperature plasma generator having reduced radio frequency noise emissions, comprising:

(a) a chamber formed of a material that is substantially electrically nonconductive, said chamber including a vacuum port adapted for connection to a vacuum pump and an inlet port adapted for connection to a source of a gas;

(b) a first and a second electrode disposed in proximity to the chamber, spaced apart, but generally adjacent each other;

(c) a radio frequency power source;

(d) a transformer having primary terminals connected to the radio frequency power source, and secondary terminals isolated from ground potential upon which potentials are developed having opposite polarity in respect to each and varying about ground potential; and (e) balanced impedance matching means electrically connecting the secondary terminals of the transformer to the first and second electrodes, for matching an output impedance of the secondary terminals to an input impedance of the first and the second electrodes.

2. The plasma generator of claim 1, wherein the balanced impedance matching means comprise a balanced LC circuit having a first current path referenced to the first electrode and ground potential and a second current path referenced to the second electrode and ground potential.

3. The plasma generator of claim 2, wherein the first and second current path of the balanced LC circuit each includes a variable inductor and a variable capacitor so that the impedance of the circuit may be adjusted.

4. The plasma generator of claim 1, wherein the chamber includes a glow discharge section and a test section.

5. The plasma generator of claim 4, wherein the inlet port and the first and second electrodes are disposed on the glow discharge section and the vacuum port is disposed on the test section.

6. The plasma generator of claim 5, wherein the first and second electrodes are disposed on the outside surface of the glow discharge section, at opposite sides thereof, and comprise curved metal plates.

7. The plasma generator of claim 5, further comprising a ground potential electrode, disposed inside the test section, proximate the vacuum port, which is connected to ground potential by a conductive lead that passes through the substantially electrically nonconductive material forming the chamber.

8. The plasma generator of claim 1, wherein the transformer is a balun transformer.

9. In combination with a low temperature plasma generator, a power supply for providing a balanced impedance high voltage radio frequency potential to a pair of electrodes on the plasma generator comprising:

(a) a radio frequency power source;

(b) a transformer having a first winding connected to an output of the radio frequency power source and a second winding connected to a pair of output terminals, potentials on the output terminals varying about ground potential and being of opposite polarity in respect to each other;

(c) a balanced impedance matching circuit electrically connecting the output terminals of the transformer to the electrodes of the plasma generator; and (d) means for adjusting the impedance of the impedance matching circuit to match an output impedance of the transformer to a dynamic input impedance of the electrodes, the input impedance of the electrodes being subject to change during operation of the plasma generator.

10. The power supply of claim 9, wherein the means for adjusting the impedance comprise a first and a second variable capacitor connected between the output terminals and ground potential.

11. The power supply of claim 9, wherein the means for adjusting the impedance comprise a first and a second variable inductor connected between the output terminals of the transformer and the electrodes of the plasma generator.

12. The power supply of claim 9, wherein the balanced impedance matching circuit includes a first and a second capacitor connected between the output terminals and ground potential, and a first and a second inductor connected between the output terminals and the electrodes.

13. The power supply of claim 12, wherein the first and the second capacitor and the first and the second inductor are adjustable and comprise said means for adjusting the impedance.

14. The power supply of claim 9, wherein the transformer is a balun transformer having at least three series connected windings, with a tap between a first and a second of the windings and a tap between the second and a third of the windings.

15. The power supply of claim 14, wherein the radio frequency power source is connected to one end of the three series connected windings and to the tap between the second and the third winding, and wherein the output terminals are connected to the other end of the three series connected windings and to the tap between the first and the second windings, ground potential being connected to the tap between the second and third windings.

16. A method of reducing radio frequency emissions from a low temperature plasma generator having a pair of electrodes for generating a plasma discharge, comprising the steps of:

(a) using a transformer, converting a radio frequency power source signal referenced to ground potential into a pair of signals that vary about ground potential with opposite polarity in respect to each other;

(b) approximately matching an output impedance of the transformer to an input impedance of the two electrodes using an impedance matching network that connects the signals to the two electrodes, so that the pair of signals are balanced when applied to the electrodes; and (c) trimming the impedance matching to compensate for dynamic changes in the input impedance of the two electrodes during operation of the plasma generator.

17. The method of claim 16, wherein neither of the two electrodes are at ground potential.

18. The method of claim 16, wherein the step of trimming the impedance matching comprises the step of varying a capacitance between the two electrodes and ground.

19. The method of claim 16, wherein the step of trimming the impedance matching comprises the step of varying an inductance between the two electrodes and the transformer.

* * * * *